US008176578B2

(12) United States Patent
Hatrick-Smith et al.

(10) Patent No.: US 8,176,578 B2
(45) Date of Patent: May 15, 2012

(54) BATH WITH INTERCHANGEABLE FITTING

(75) Inventors: John Hatrick-Smith, Glenfield (NZ); David Gordon Arthur Crichton, Glenfield (NZ)

(73) Assignee: Kohler New Zealand Limited, Glenfield, Auckland (NZ)

( * ) Notice: Subject to any disclaimer, the term of this patent is extended or adjusted under 35 U.S.C. 154(b) by 1339 days.

(21) Appl. No.: 10/576,459

(22) PCT Filed: Oct. 22, 2004

(86) PCT No.: PCT/NZ2004/000266

§ 371 (c)(1),
(2), (4) Date: Mar. 7, 2007

(87) PCT Pub. No.: WO2005/037042

PCT Pub. Date: Apr. 28, 2005

(65) Prior Publication Data

US 2007/0251001 A1 Nov. 1, 2007

(30) Foreign Application Priority Data

Oct. 22, 2003 (NZ) ..... 529080

(51) Int. Cl.
*A47K 3/00* (2006.01)

(52) U.S. Cl. ..... 4/541.1; 4/541.3; 4/546; 4/559; 4/568; 4/575.1

(58) Field of Classification Search ..... 4/507, 541.1, 4/541.3, 546, 559, 568, 569, 571.1, 571.3, 4/575.1, 591, 605, 611
See application file for complete search history.

(56) References Cited

U.S. PATENT DOCUMENTS

| | | | | |
|---|---|---|---|---|
| 963,945 | A | 7/1910 | Sandham | |
| 1,054,922 | A | 3/1913 | Kenney | |
| 2,073,307 | A | 3/1937 | Isenberg | |
| 3,967,323 | A | 7/1976 | Serio | |
| 4,572,165 | A | 2/1986 | Dodier | |
| 4,896,383 | A | 1/1990 | Morgan et al. | |
| 4,912,782 | A | 4/1990 | Robbins | |
| 5,010,605 | A | 4/1991 | Shiina et al. | |
| 5,276,926 | A | 1/1994 | Lopez | |
| 5,333,324 | A * | 8/1994 | Pinciaro | 4/541.1 |

(Continued)

FOREIGN PATENT DOCUMENTS

| | | |
|---|---|---|
| AU | 40285/95 | 6/1996 |

(Continued)

OTHER PUBLICATIONS

International Search Report corresponding to PCT/NZ2004/000266, under date of mailing of Feb. 25, 2005.

*Primary Examiner* — Steven J Ganey
(74) *Attorney, Agent, or Firm* — Foley & Lardner LLP

(57) ABSTRACT

A bath includes in or associated with an upper wall or rim section of the bath at least one water connection, a neck water outlet fitting 2 interchangeably connectable to the water connection to when connected direct a flow of water generally centrally on to the neck and/or upper back of a bather reclining against the adjacent bath wall, and a shoulders water outlet fitting or fittings 15 interchangeably connectable to the water connection to when connected direct a flow of water on to the shoulders or front shoulder regions of a bather reclining against the adjacent bath wall.

25 Claims, 7 Drawing Sheets

U.S. PATENT DOCUMENTS

| | | | | |
|---|---|---|---|---|
| 5,495,627 | A | | 3/1996 | Leaverton et al. |
| 5,537,696 | A | | 7/1996 | Chartier et al. |
| 5,548,854 | A | | 8/1996 | Bloemer et al. |
| 5,647,072 | A | | 7/1997 | Shaffer et al. |
| 5,682,625 | A | * | 11/1997 | Leaverton et al. ..... 4/541.1 |
| 5,928,171 | A | * | 7/1999 | Larsen ..... 4/546 |
| 6,092,246 | A | * | 7/2000 | Ludlow ..... 4/541.6 |
| 6,182,303 | B1 | | 2/2001 | Gardenier et al. |
| 6,256,805 | B1 | | 7/2001 | Ludlow et al. |
| 6,289,529 | B1 | | 9/2001 | Harvey |
| 2002/0053105 | A1 | | 5/2002 | Turner |
| 2003/0000009 | A1 | | 1/2003 | Brennan et al. |
| 2004/0148694 | A1 | | 8/2004 | Brennan et al. |

FOREIGN PATENT DOCUMENTS

| | | | |
|---|---|---|---|
| CH | 645 798 | | 10/1984 |
| CN | 2436076 | | 6/2001 |
| CN | 2457952 | | 11/2001 |
| DE | 3137406 | | 4/1983 |
| EP | 415 058 | | 7/1990 |
| FR | 2677899 | | 12/1992 |
| JP | 5084267 | A | 4/1993 |
| JP | 5200079 | A | 8/1993 |
| JP | 9010272 | A | 1/1997 |
| JP | 2000139741 | A | 5/2000 |
| JP | 2002209967 | A | 7/2002 |
| JP | 2002238788 | A | 8/2002 |
| WO | WO9611661 | A1 | 4/1991 |
| WO | WO9801098 | A1 | 1/1998 |
| WO | WO 00/62656 | | 10/2000 |
| WO | WO 01/74223 | | 10/2001 |
| WO | WO2004/056248 | A1 | 7/2004 |

* cited by examiner

BATH WITH INTERCHANGEABLE FITTING

CROSS-REFERENCE TO RELATED APPLICATIONS

This application claims priority of PCT Patent Application PCT/NZ2004/000266, filed 22 Oct. 2004, which claims priority of New Zealand Patent Application Number 529080 filed 22 Oct. 2003.

FIELD OF INVENTION

The invention comprises an improved form of bath with one or more of an interchangeable neck jet pillow fitting and a fitting (or fittings) which deliver water on to the shoulders of a bather.

BACKGROUND OF THE INVENTION

A standard bath typically is filled generally with warm water, from taps or a mixer and spout, and is used for bathing.

A spa bath also incorporates an intake and a number of spa jets positioned in the bath side walls, and piping around the exterior of the bath, through which water is circulated from an intake to the jets in the side walls of the bath by one or more pumps. A spa bath provides the bather(s) with a more luxuriant bathing experience.

A whirpool available from Kohler Co may include a pillow with one or more associated neck jets that deliver water at the base of a reclining bathers neck (see www.kohlerco.com).

SUMMARY OF THE INVENTION

It is an object of the invention to provide an improved or at least alternative form of bath, which enables further enhancement of the bathing experience.

In broad terms in one aspect the invention comprises a bath including: in or associated with an upper wall or rim section of the bath at least one water connection, a neck water outlet fitting interchangeably connectable to the water connection to when connected direct a flow of water generally centrally on to the neck and/or upper back of a bather reclining against the adjacent bath wall, and a shoulders water outlet fitting or fittings interchangeably connectable to the water connection to when connected direct a flow of water on to the shoulders or front shoulder regions of a bather reclining against the adjacent bath wall.

Preferably the bath includes in or associated with each of two or more spaced upper wall or rim sections of the bath at least one water connection to which either said neck or water outlet fitting or shoulders water outlet fitting(s) can be interchangeably connected.

Preferably each of said water connections incorporates a one way valve which is opened by connection of either of said neck or shoulders water outlet fittings to the water connection and is closed to prevent water flow from the connection when the water outlet fitting is removed.

The neck water outlet fitting is arranged to deliver a flow of water which is wider than it is deep.

Preferably the shoulders water outlet fitting(s) provide two spaced water outlets one positioned to direct a water flow onto the left-side upper body of a bather and the other positioned to direct a water flow at the same temperature onto the right-side upper body of the bather.

The shoulders water outlets may be each arranged to deliver a flow of water which is wider than it is deep.

Preferably the bath includes a pump and water recirculation system arranged to recirculate a flow of water from the bath through the neck and shoulders water outlet fittings. The bath may also include a suction inlet from which water is drawn and a number of spa outlets or jets in the walls of the bath through which water is recirculated back into the bath.

In broad terms another aspect of the invention comprises a bath including: one or more water connections provided in an upper wall or rim section of the bath at at least two space locations about the bath, a neck water outlet fitting interchangeably connectable to said water connection(s) at any of said locations about the bath to deliver water from above the water level in the bath onto the neck and/or upper back of a bather reclining against the bath wall below the neck water outlet fitting, and a pair of left and right shoulders water outlet fittings connectable to the water connection(s) at any of said locations about the bath so that when connected said shoulders water outlet fittings comprise left and right side fittings positioned to direct a water flow from above the water level in the bath onto the left side and right side respectively of a bather reclining against the bath wall below the shoulders water outlet fittings.

The neck and shoulders fittings can be interchangeably connected to the water connection(s) of the bath provided for this purpose, which is/are typically positioned in one or more junction portions of the bath which each join a wall section of the bath which defines the bath cavity, with a surrounding rim section around the bath cavity, without the use of tools ie manually by a bather before using the bath, who may select which fitting to use, if any.

In a preferred form the shoulders fitting comprises two spaced apart water outlets which will in use direct a flow of water onto the shoulders and/or front upper body of a person sitting in the bath between the two shoulders outlets, against the bath wall. The two spaced water outlets may be provided by two separate fittings, one positioned so that it will in use direct a water flow onto the left-side upper body of the bather and the other positioned so that it will direct a water flow into the right-side of the upper body of the bather.

Preferably the separate shoulder fittings are rotatably or pivotably mounted so that each may be pivoted to alter the angle of water flow, enabling a bather to optimize the water flow onto the bather. However in an alternative form the shoulders water outlet fitting may for example be arranged to direct a wide flow of water across the shoulders region of a bather, from behind. The water flow may be the bath water recirculated by one or more pumps such as the spa pump in the case of a spa bath or similar, or by another dedicated pump, or fresh warm (or cold) water (non-recirculated).

In a preferred form the neck water outlet fitting is associated with a pillow formed of a compressible material such as synthetic foam which may be fitted to a junction portion of the bath which joins a wall section of the bath which defines the bath cavity with a surrounding rim section around the bath cavity. The pillow includes one or more apertures through which water is delivered (through the pillow) onto the back of the neck and top of the back of a bather. Alternatively the pillow may be formed of a water permeable material or comprise a water permeable covering material.

A standard (single person) bath may include a water supply connection at one end of the bath only. A bath designed to accommodate two persons sitting in the bath against opposite ends of the bath may incorporate water supply connections at both ends of the bath. A bath designed to accommodate two persons sitting side by side may incorporate side by side water supply connections side by side. A spa bath or pool designed to accommodate up to three or more persons may incorporate water supply connections in accordance with the invention at a number of seating positions around the bath or pool. In this specification the term "bath" is intended to also include spa baths and spa pools, including and also known as spas, whirlpools, and jacuzzis.

BRIEF DESCRIPTION OF THE DRAWINGS

The invention is further illustrated by the following description of an embodiment of a bath of the invention, which is described by way of example and without intending to be limiting. In the drawings.

DETAILED DESCRIPTION OF PREFERRED FORM

Figure 1:
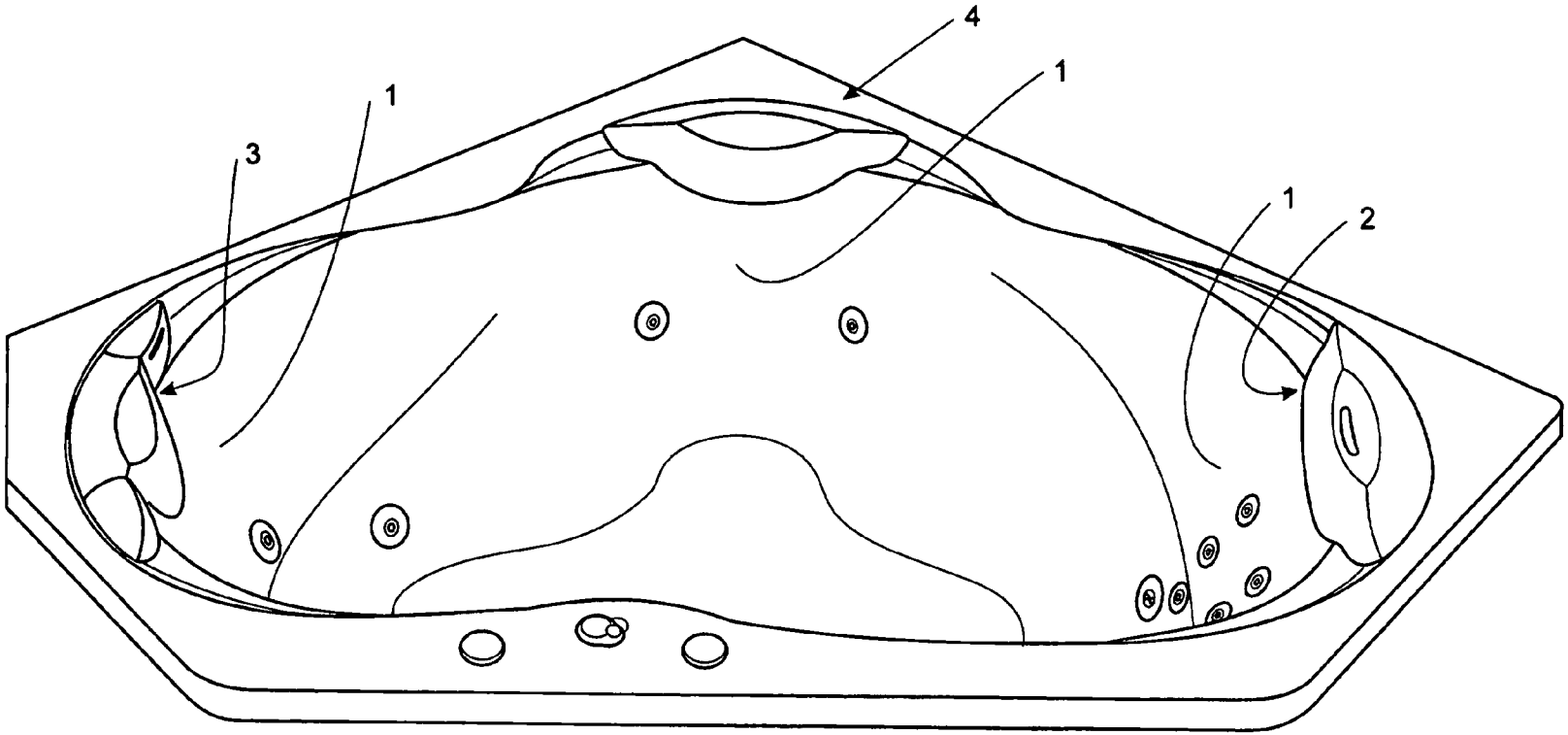
FIG. 1 is a perspective view generally showing a bath with interchangeable neck pillow and shoulders fittings of the invention.

Referring to FIG. 1, the bath shown therein is a spa bath designed to accommodate up to three persons. The bath incorporates an inlet from which water is drawn and a number of spa outlets or jets from which water is pumped back into the bath. Parts 1 of the walls of the bath are shaped so as to be comfortable for bathers sitting in the bath and leaning back against the side of the bath.

Figure 4:
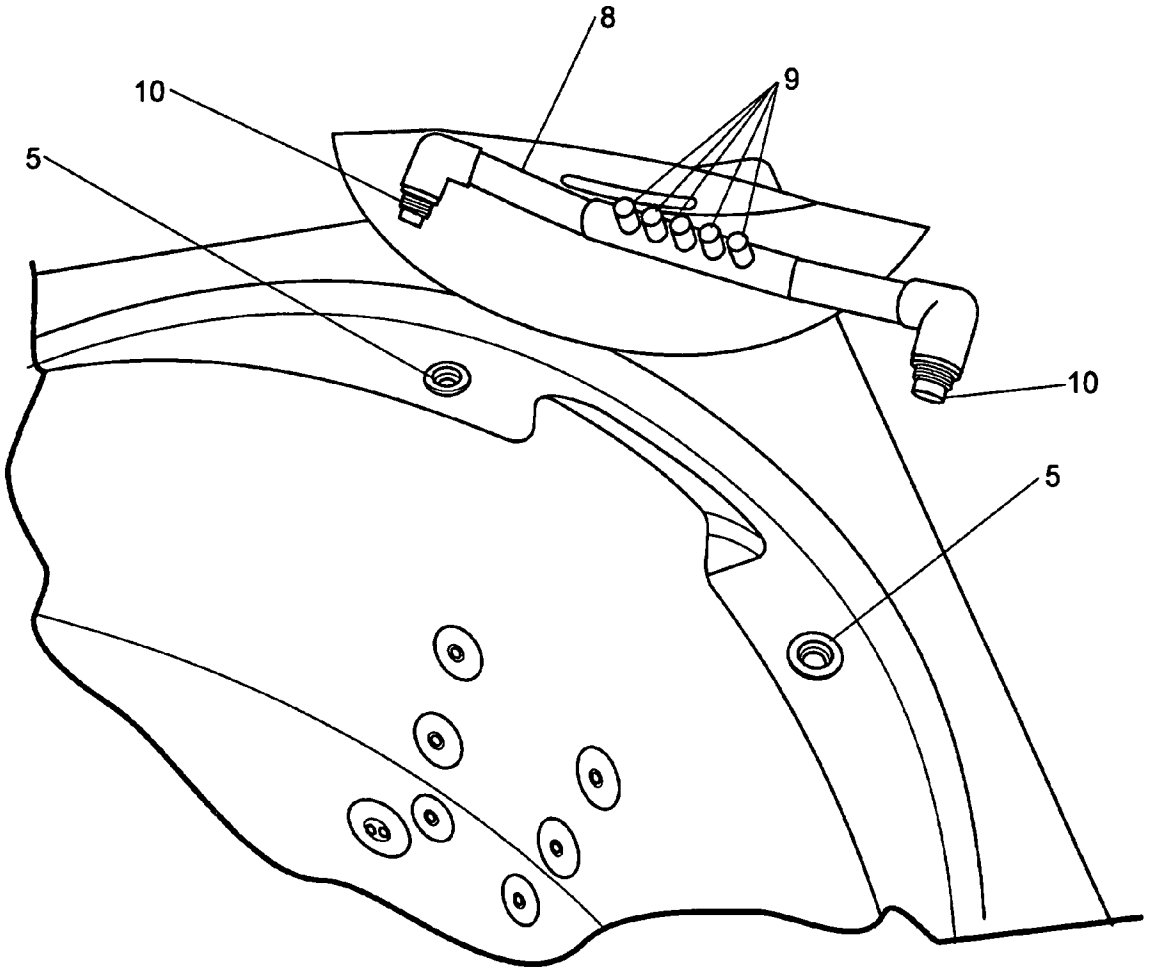
FIG. 4 is a view similar to FIG. 3 but with the pipe fitting disconnected from two water connections in the bath.
Figure 6:
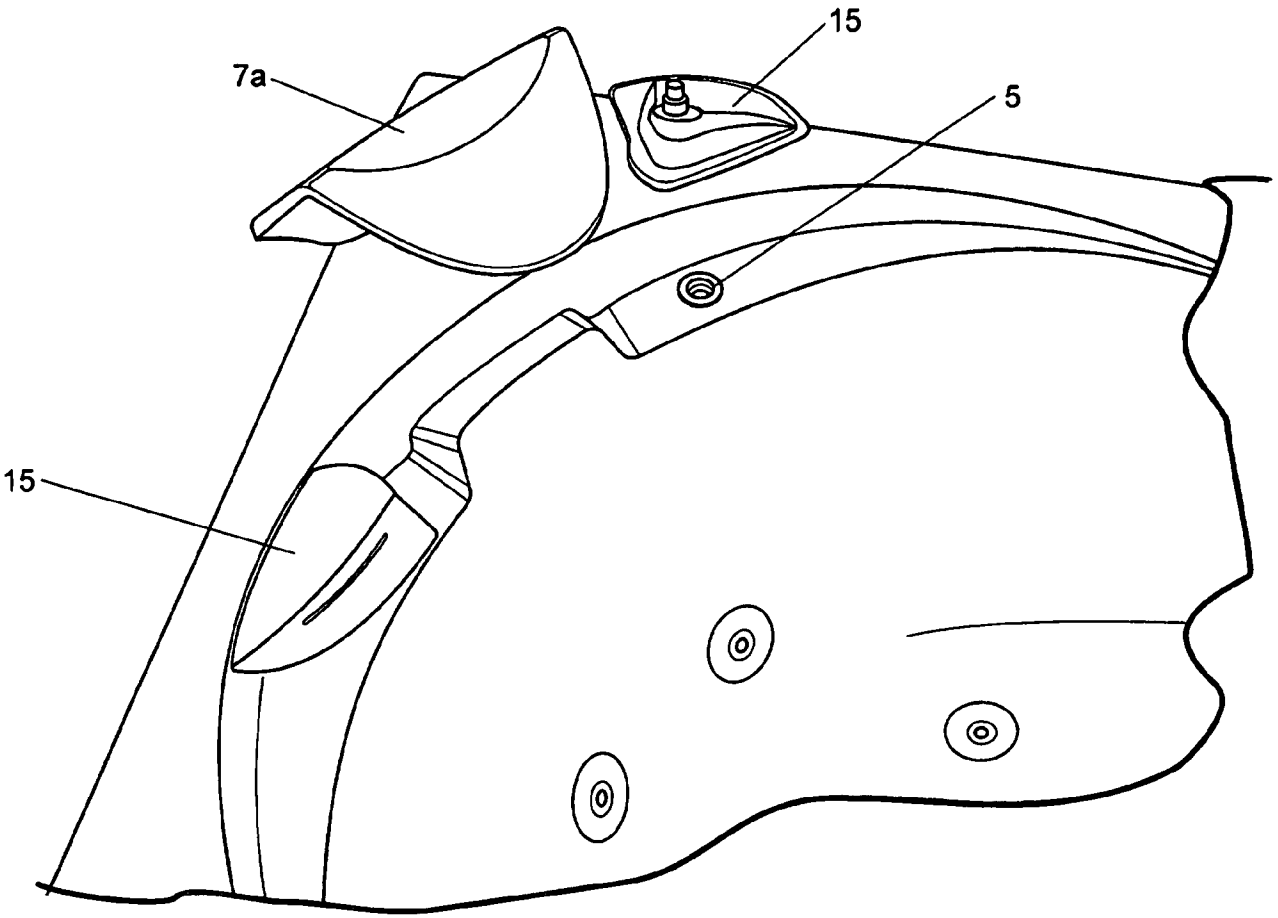

The bath is shown in FIG. 1 configured with a neck water outlet fitting indicated generally at 2, a shoulders water outlet fitting at 3, and a simple pillow at 4. Referring particularly to FIGS. 4 and 6, water connections 5 are provided above each position 1, in the upper wall of the bath and in particular as shown in a junction portion of the bath which joins the wall of the bath with the surrounding rim section around the bath cavity.

When the bath is filled with water and a pump operated (which may be the spa pump of a spa bath or a separate pump), water is delivered from the water connections 5. Where a neck fitting is provided as at 2, water is directed by the neck fitting to flow onto the back of the neck and/or the upper back of a person sitting in the bath and leaning against the bath wall, and typically resting their head on the associated compressible pillow. The shoulders fittings 3 will deliver water onto the shoulders and/or front upper body of a bather. The neck and shoulders fittings are interchangeable they may be unplugged from and swapped between the water connections 5. Alternatively the neck and/or shoulders fittings at one or more of the bathing position(s) maybe removed altogether and optionally replaced with a simple pillow. For example in the case of a bath for two persons having a bathing position at either end, two neck pillows/fittings 2 may be provided at either end of the bath or alternatively two shoulders fittings 3, or neck fittings at one end and shoulder fittings at the other. In a three or four person bath the neck and or shoulder fittings of each bathing position are similarly interchangeable or removable. Preferably the water supply connections 5 each incorporate a one way valve which is normally closed to prevent water from flowing, and which is opened (only) when a neck fitting or shoulders fitting is plugged into the water supply connection.

Figure 2:
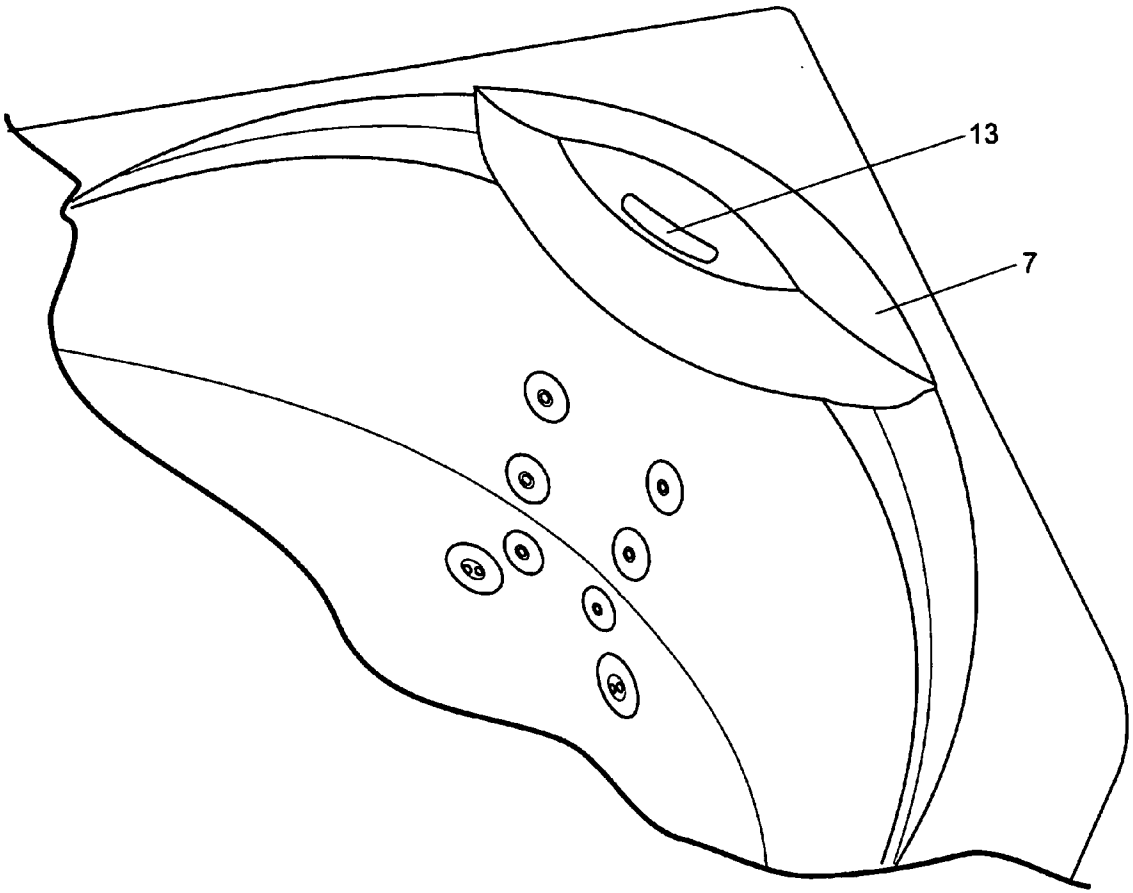
FIG. 2 is a close up view of the neck pillow fitting of the bath.
Figure 3:
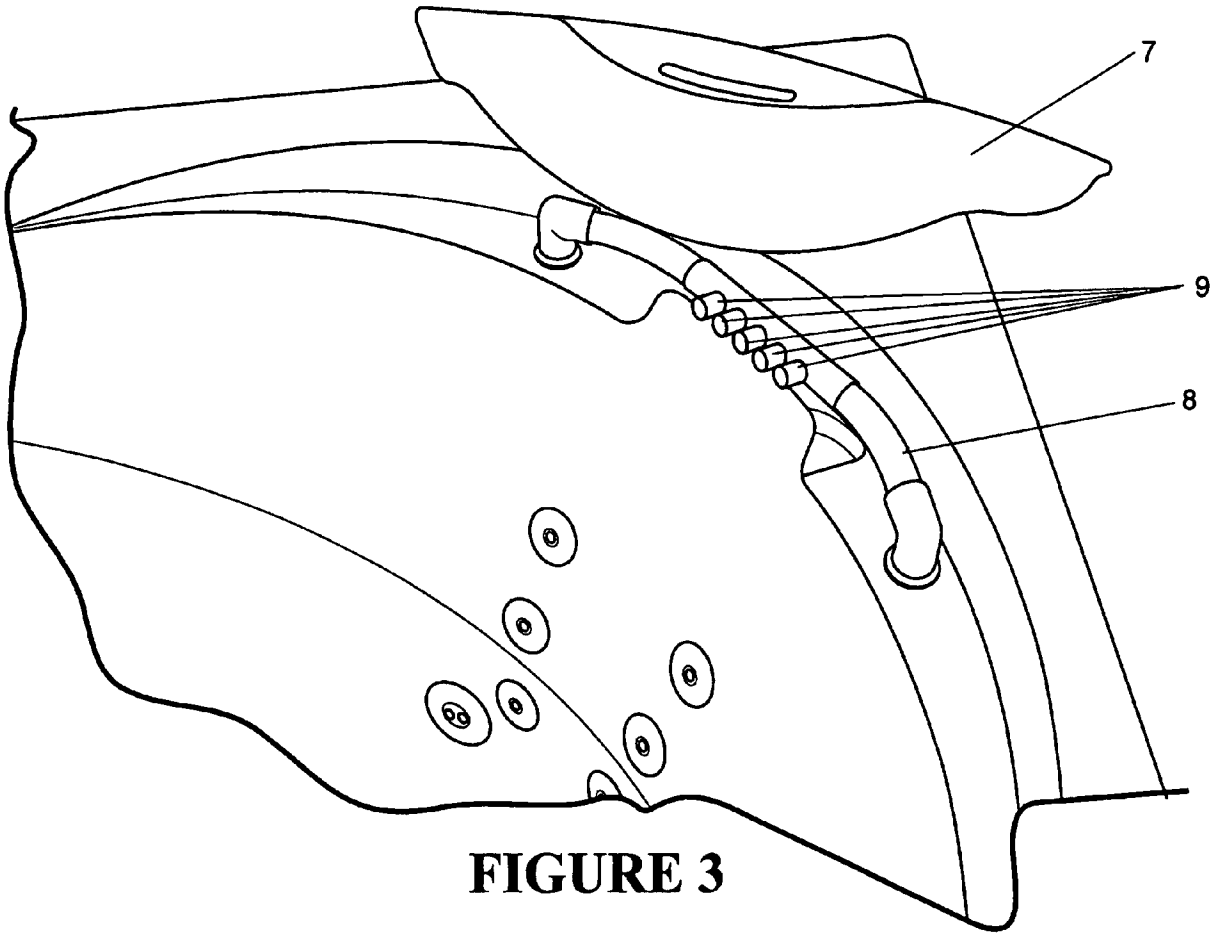
FIG. 3 shows the pillow removed, but with a pipe fitting on which the neck pillow sits and which delivers water through the pillow in place.

Referring in particular to FIGS. 2, 3 and 4, the neck fitting in the preferred form comprises an optional pillow 7 formed for example of a compressible material such as synthetic foam, and a pipe fitting 8 with water outlets 9, and a plug fitting 10 at either end which enables the pipe fitting to be connected to the bath by plugging its either end 10 into water outlets 5 as shown in FIG. 3. The pillow 7 is then placed over the pipe fitting 8. The pillow 7 incorporates an aperture 13 through which water is in use delivered, which will gently hit the back of the neck and upper back of the bather (depending on the height of the bather). Alternatively the pillow maybe formed of a water permeable material or comprises a water permeable covering material and water is delivered through the pillow onto the back of the neck and/or upper back of a bather.

Figure 5:
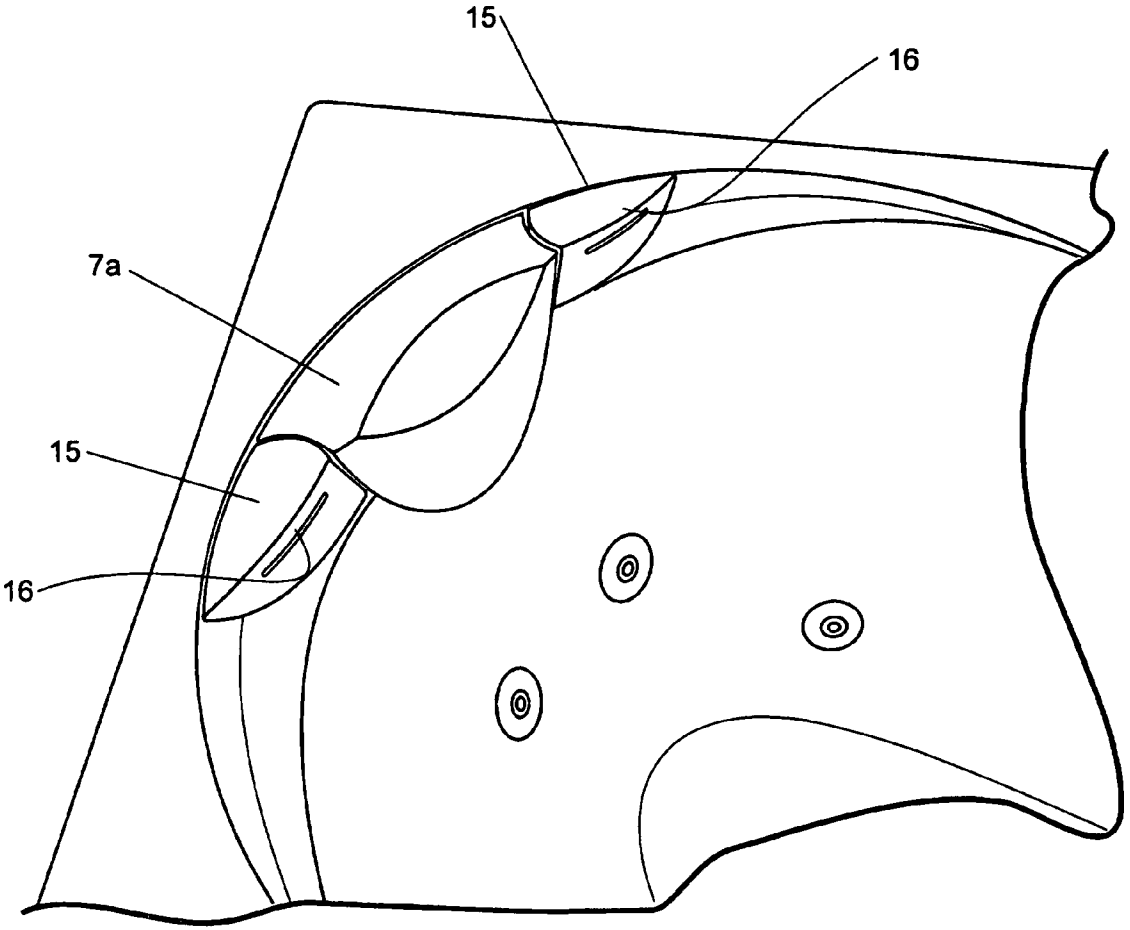
FIG. 5 is a close up view of the shoulders water outlet fittings of the bath, which also incorporate a neck pillow between, FIG. 6 is a view similar to FIG. 5 but with one of the shoulders water outlet fittings disconnected from one of the water connections in the bath, and with the neck pillow removed.

Referring to FIGS. 1, 4 and 5, to provide shoulders fittings a pillow 7 is optionally provided which may again be formed from a synthetic foam material for example, and on either side of the pillow are mounted left and right shoulders water fittings 15 including outlets 16, which are also when in place connected to the water connections 5 so that they will in use direct a flow of water onto the shoulders and/or upper body of a bather sitting in the bath, on both the left and right sides as shown. Preferably the fittings 15 provide water outlets 16 which are elongate in shape as shown so that the flow of water from each fitting 15 is wider than it is deep, or laminar, so that when the water flows impact the shoulders of a bather they will cover and warm as much of the bathers upper body exposed above the water in the bath, as possible. It has been found optimal for achieving a flat laminar flow that the slot-shaped water outlets have a slightly larger dimension at either end of the slot relative to the centre width of the slot. Alternatively however the outlets 16 may comprise a number of smaller elongate or circular outlets for example.

Figure 7:
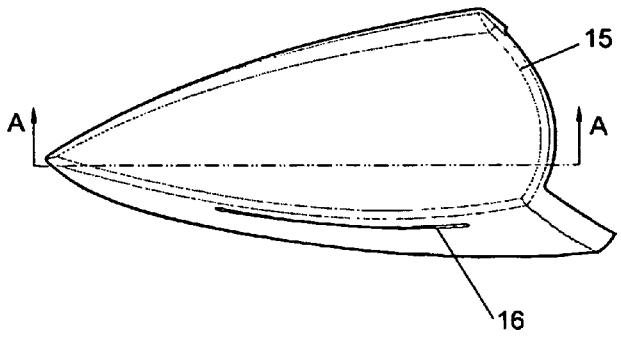
FIG. 7 is a view from above of one of the shoulders water fittings.
Figure 8:
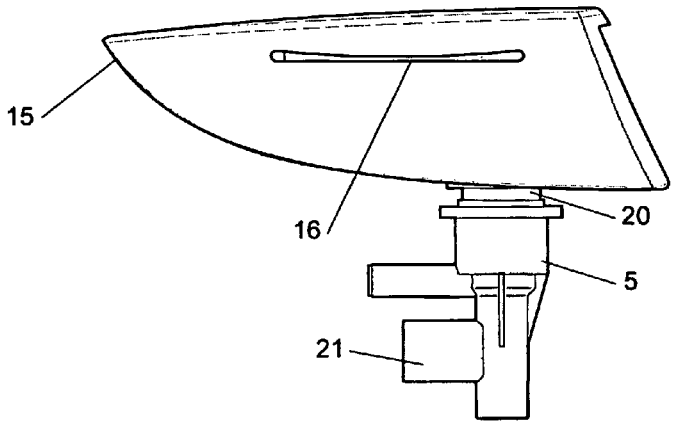
FIG. 8 is a front view of the shoulders water fitting.
Figure 9:
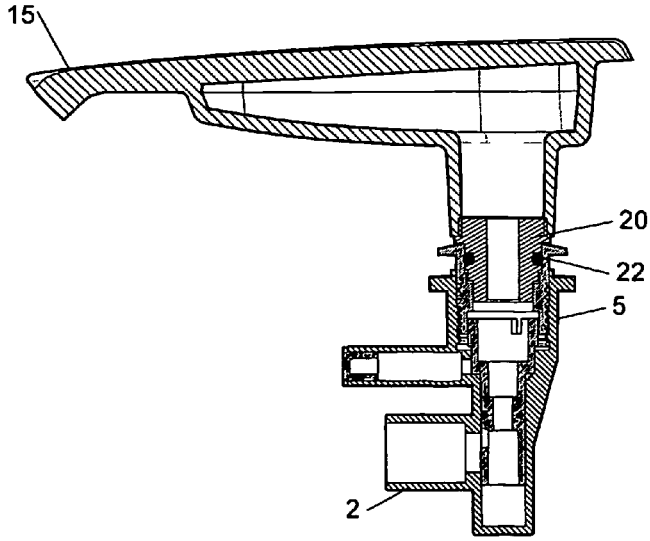
FIG. 9 is a cross-section view of one of the shoulders water fittings.

FIGS. 7 to 9 show one form of a single fitting 15 by way of example. The fitting which has a hollow interior also has a hollow mounting neck 20 which can removably plug into a water supply connection 5 shown in cross-section and separate from the bath wall. A user can pivot the fitting 15 in the direction of arrows P by pushing or pulling the top of the fitting. A pipe 21 from the water pump of the bath or alternatively a separate pump, connects to the part 5 and an more O-ring seals between the mounting neck 20 and the water connection 5.

In the bath shown by way of example each fitting 15 can pivot inwardly around its mounting neck 20 in water outlet 5, which enables a bather sitting in the bath to perfect the aim of the water flow onto the bathers upper body. In an alternative form the shoulders water fittings similar to those shown may be fixed rather than having the ability to be pivoted by a bather as described.

Preferably the shoulders outlet fittings are shaped so that they blend smoothly into the shape of the bath as shown.

The foregoing describes the invention including a preferred form thereof. Alterations and modifications as will be obvious to those skilled in the art are intended to be incorporated in the scope hereof as defined in the accompanying claims.

What we claim is:

1. A bath comprising:

in or associated with an upper wall or rim section of the bath at least one water connection, a neck water outlet fitting interchangeably connectable to the water connection to when connected direct a flow of water generally centrally on to the neck and/or upper back of a bather reclining against an adjacent bath wall section, and a shoulders water outlet fitting or fittings interchangeably connectable to the water connection to when connected direct a flow of water on to the shoulders or front shoulder regions of a bather reclining against the adjacent bath wall section;

wherein the at least one water connection may be connected to either the neck water outlet fitting or the shoulders water outlet fitting or fittings at a given time.

2. A bath according to claim 1 including in or associated with each of two or more spaced upper wall or rim sections of the bath at least one water connection to which either said neck water outlet fitting or shoulders water outlet fitting(s) can be interchangeably connected.

3. A bath according to claim 2 wherein said water connections are provided in different upper wall or rim sections of the bath each above the adjacent bath wall section of the bath which is shaped to accommodate a bather sitting in the bath and reclining thereagainst.

4. A bath according to claim 1 wherein the neck water outlet fitting is arranged to deliver a flow of water which is wider than it is deep.

5. A bath according to claim 1 wherein the shoulders water outlet fitting(s) provide two spaced water outlets, one positioned to direct a water flow onto the left-side upper body of a bather and the other positioned to direct a water flow at the same temperature onto the right-side upper body of the bather.

6. A bath according to claim 5 wherein the shoulders water outlets are each arranged to deliver a flow of water which is wider than it is deep.

7. A bath according to claim 5 wherein the shoulders water outlet fittings are provided on either side of a central pillow.

8. A bath according to claim 1 wherein the shoulders water outlet fitting(s) include two spaced apart left and right side shoulders fittings one positioned to direct a water flow onto the left-side of a bather and the other positioned to direct a water flow at the same temperature onto the right-side upper body of the bather.

9. A bath according to claim 1 wherein said upper wall or rim section of the bath is part of an end wall section which is approximately convexly curved over at least a part of the height of the wall section.

10. A bath according to claim 1 including a pump and water recirculation system arranged to recirculate a flow of water from the bath through the neck and shoulders water outlet fittings.

11. A bath according to claim 10 wherein one or more of said spa outlets or jets are provided in a wall section of the bath to direct water against the back of the bather.

12. A bath according to claim 1 which also includes a section inlet from which water is drawn and a number of spa outlets or jets in the walls of the bath through which water is recirculated back into the bath.

13. The bath according to claim 1, wherein the at least one water connection incorporates a one way valve which is opened by connection of either of said neck or shoulders water outlet fittings to the at least one water connection and is closed to prevent water flow from the connection when the water outlet fitting is removed.

14. A bath comprising:

in or associated with an upper wall or rim section of the bath at least one water connection, a neck water outlet fitting interchangeably connectable to the one water connection to when connected direct a flow of water generally centrally on to the neck and/or upper back of a bather reclining against an adjacent bath wall section, and a shoulders water outlet fitting or fittings interchangeably connectable to the water connection to when connected direct a flow of water on to the shoulders or front shoulder regions of a bather reclining against the adjacent bath wall section;

wherein the neck water outlet fitting is associated with a pillow formed of a compressible material which can be fitted to the bath; and wherein the pillow is formed of a water permeable material or comprises a water permeable covering material and water is delivered through the pillow onto the back of the neck and/or upper back of a bather;

wherein the at least one water connection may be connected to either the neck water outlet fitting or the shoulders water outlet fitting or fittings at a given time.

15. A bath according to claim 14 wherein the pillow includes one or more apertures through which water is delivered through the pillow onto the back of the neck and/or upper back of a bather.

16. A bath according to claim 14 wherein the pillow fits over and is a separate component from the neck water outlet fitting.

17. The bath according to claim 14, wherein the at least one water connection comprises two or more water connections, wherein each water connection may be connected to either the neck water outlet fitting or the shoulders water outlet fitting or fittings at a given time.

18. A bath comprising:

in or associated with a an upper wall or rim section of the bath two water connections, a neck water outlet fitting interchangeably connectable at two ends to said two water connections to when connected direct a flow of water generally centrally on to the neck and/or upper back of a bather reclining against an adjacent bath wall section, wherein the neck water outlet fitting comprises one or more water outlets intermediate of the fitting between the two ends thereof; and a shoulders water outlet fitting or fittings interchangeably connectable to at least one of the water connections to when connected direct a flow of water on to the shoulders or front shoulder regions of a bather reclining against the adjacent bath wall section;

wherein each water connection may be connected to either one of the two ends of the neck water outlet fitting or the shoulders water outlet fitting or fittings at a given time.

19. The bath according to claim 18, further comprising a pillow positionable over the neck fitting.

20. The bath according to claim 19, wherein the pillow comprises one or more apertures one or more apertures through which water from the neck fitting may pass.

21. The bath according to claim 19, wherein the pillow is formed of a water permeable material or comprises a water permeable covering material.

22. The bath according to claim 19, wherein the pillow comprises a compressible material.

23. A bath comprising:

in or associated with an upper wall or rim section of the bath two or more water connections, a neck water outlet fitting interchangeably connectable to one of the water connections to when connected direct a flow of water generally centrally on to the neck and/or upper back of a bather reclining against an adjacent bath wall section, and a shoulders water outlet fitting or fittings interchangeably connectable to one of the water connections to when connected direct a flow of water on to the shoulders or front shoulder regions of a bather reclining against the adjacent bath wall section;

wherein the shoulders water outlet fitting(s) provide two spaced water outlets, one positioned to direct a water flow onto the left-side upper body of a bather and the other positioned to direct a water flow at the same temperature onto the right-side upper body of the bather;

wherein the shoulders water outlets are each arranged to deliver a flow of water which is wider than it is deep; and wherein the shoulders water outlet fittings are pivotally mounted to enable adjustment of the direction of water flow from the fittings onto the bathers upper body;

wherein each water connection may be connected to either the neck water outlet fitting or the shoulders water outlet fitting or fittings at a given time.

24. A bath according to claim 23 wherein the left and right side shoulders water outlet fittings each comprise a hollow interior and a hollow mounting neck by which the fitting is pivotally connectable to a said water connection in said upper wall or rim section of the bath.

25. A bath according claim 23 wherein the left and right side shoulders water outlet fittings are integral with a pillow and comprise flexible side portions of said pillow.

* * * * *